US005601744A

United States Patent [19]

Baldwin

[11] Patent Number: 5,601,744

[45] Date of Patent: Feb. 11, 1997

[54] DOUBLE-WALLED MICROWAVE CUP WITH MICROWAVE RECEPTIVE MATERIAL

[75] Inventor: Wayne D. Baldwin, Asheboro, N.C.

[73] Assignee: Vesture Corp., Asheboro, N.C.

[21] Appl. No.: 672,309

[22] Filed: Jun. 28, 1996

Related U.S. Application Data

[63] Continuation-in-part of Ser. No. 371,502, Jan. 11, 1995, abandoned.

[51] Int. Cl.[6] ..... H05B 6/80

[52] U.S. Cl. ..... 219/689; 219/759; 99/DIG. 14; 426/243

[58] Field of Search ..... 219/689, 730, 219/759; 426/107, 109, 113, 241, 243; 99/DIG. 14

[56] References Cited

U.S. PATENT DOCUMENTS

| | | | |
|---|---|---|---|
| D. 195,376 | 6/1963 | Curtis . | |
| D. 231,068 | 4/1974 | Douglas . | |
| D. 243,911 | 4/1977 | Thorud . | |
| D. 294,100 | 2/1988 | Ross . | |
| D. 333,067 | 2/1993 | Feltman, III . | |
| 4,316,070 | 2/1982 | Prosise et al. | 219/730 |
| 4,335,875 | 6/1982 | Elkin | 272/70 |
| 4,743,726 | 5/1988 | Hughes et al. | 219/759 |
| 4,795,649 | 1/1989 | Kearns et al. | 219/730 |
| 4,880,953 | 11/1989 | Manker | 219/759 |
| 4,920,964 | 5/1990 | Francis, Jr. | 128/403 |
| 4,956,533 | 9/1990 | Seaborne . | |
| 4,983,798 | 1/1991 | Eckler et al. | 219/759 |
| 5,005,374 | 4/1991 | Spitler | 62/259.3 |
| 5,008,024 | 4/1991 | Watkins . | |
| 5,070,223 | 12/1991 | Colasante | 219/759 |
| 5,079,396 | 1/1992 | Katz . | |
| 5,150,707 | 9/1992 | Anderson | 128/402 |
| 5,168,140 | 12/1992 | Welker . | |
| 5,183,787 | 2/1993 | Seaborne . | |
| 5,185,505 | 2/1993 | Grzywana . | |
| 5,211,949 | 5/1993 | Salyer | 424/402 |
| 5,295,949 | 3/1994 | Hathaway | 602/18 |
| 5,314,005 | 5/1994 | Dobry | 165/10 |
| 5,343,024 | 8/1994 | Prosise et al. . | |
| 5,403,998 | 4/1995 | Sheen et al. . | |

*Primary Examiner*—Philip H. Leung
*Attorney, Agent, or Firm*—Merchant, Gould, Smith, Edell, Welter & Smith, PA

[57] ABSTRACT

A beverage cup includes an inner vessel having walls defining a fluid retaining volume. An outer wall surrounds the inner vessel and cooperates with the inner vessel to define an enclosed chamber. A microwave receptive material is disposed within the enclosed chamber.

10 Claims, 3 Drawing Sheets

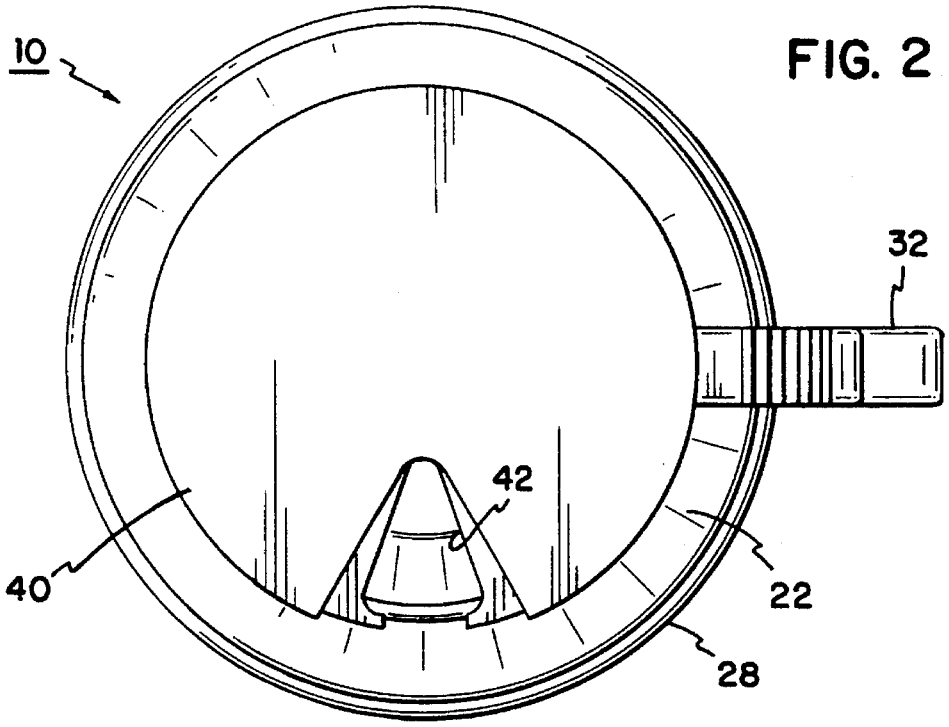
FIG. 2
FIG. 1
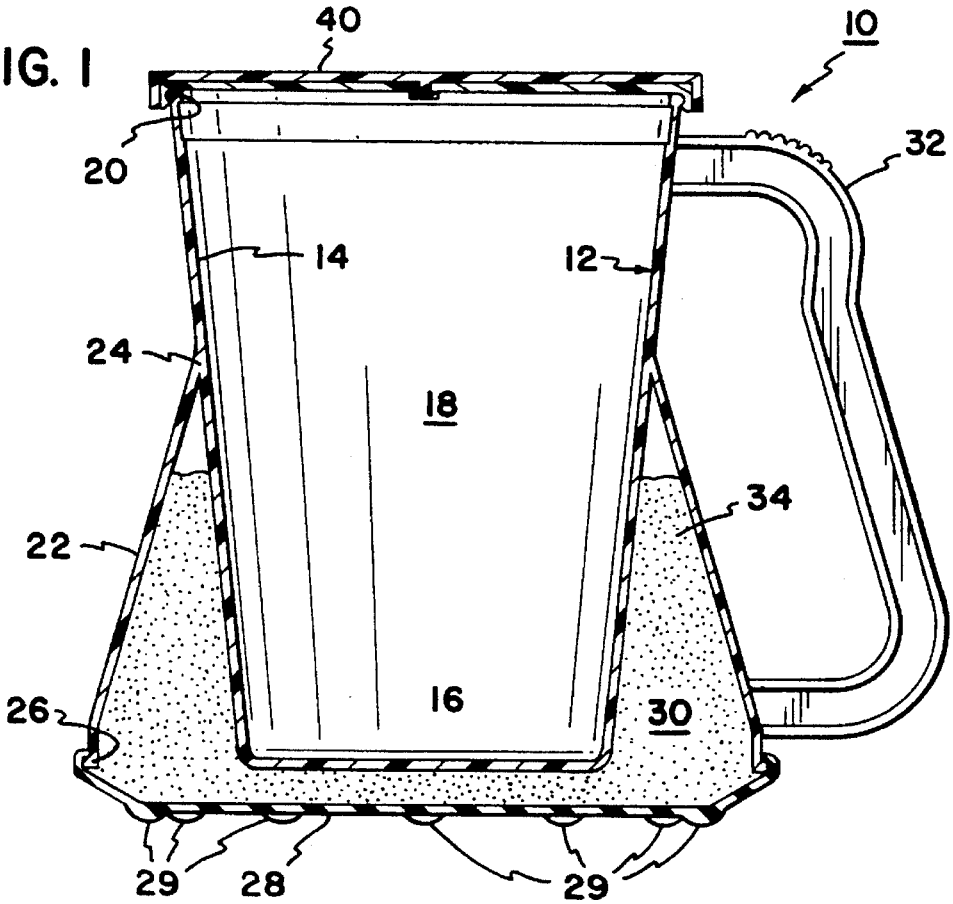

DOUBLE-WALLED MICROWAVE CUP WITH MICROWAVE RECEPTIVE MATERIAL

This is a Continuation-in-Part of application Ser. No. 08/371,502, filed Jan. 11, 1995 now abandoned.

I. BACKGROUND OF THE INVENTION

1. Field of the Invention

This invention pertains to a cup for holding beverages such as coffee or the like. More particularly, this invention pertains to such a cup which may be microwaved to ensure the beverage retains a desired temperature for a sustained period of time.

2. Description of the Prior Art

Consumers of heated beverages such as coffee, hot chocolate and the like, are frequently frustrated by the beverage losing heat. The loss of heat is particularly acute where the beverage may be intended for consumption over a long period of time (e.g., while commuting) or where the beverage is to be consumed outdoors in cold environments.

Insulated beverage containers such as insulated coffee cups are well known. Such cups include an insulated material which surrounds the contained beverage in order to reduce the rate at which the beverage loses its heat to its environment. However, even with such insulated cups, there is a desire to improve the heat retention capabilities of beverage containers.

III. SUMMARY OF THE INVENTION

According to a preferred embodiment of the present invention, a cup is provided for holding a warmed beverage. The cup includes an inner vessel having walls which define a fluid retaining volume. The vessel has an opening for admitting and discharging a beverage fluid from the volume. An outer wall at least partially surrounds the vessel. The outer wall and the walls of the inner vessel cooperate to define an enclosed chamber at least partially surrounding the inner vessel. A microwave receptive material is contained within the chamber.

IV. BRIEF DESCRIPTION OF THE DRAWINGS

FIG. 1 is a cross-sectional view of a beverage cup according to the present invention;

FIG. 2 is a top plan view of the cup of FIG. 1;

V. DESCRIPTION OF THE PREFERRED EMBODIMENT

Figure 3:
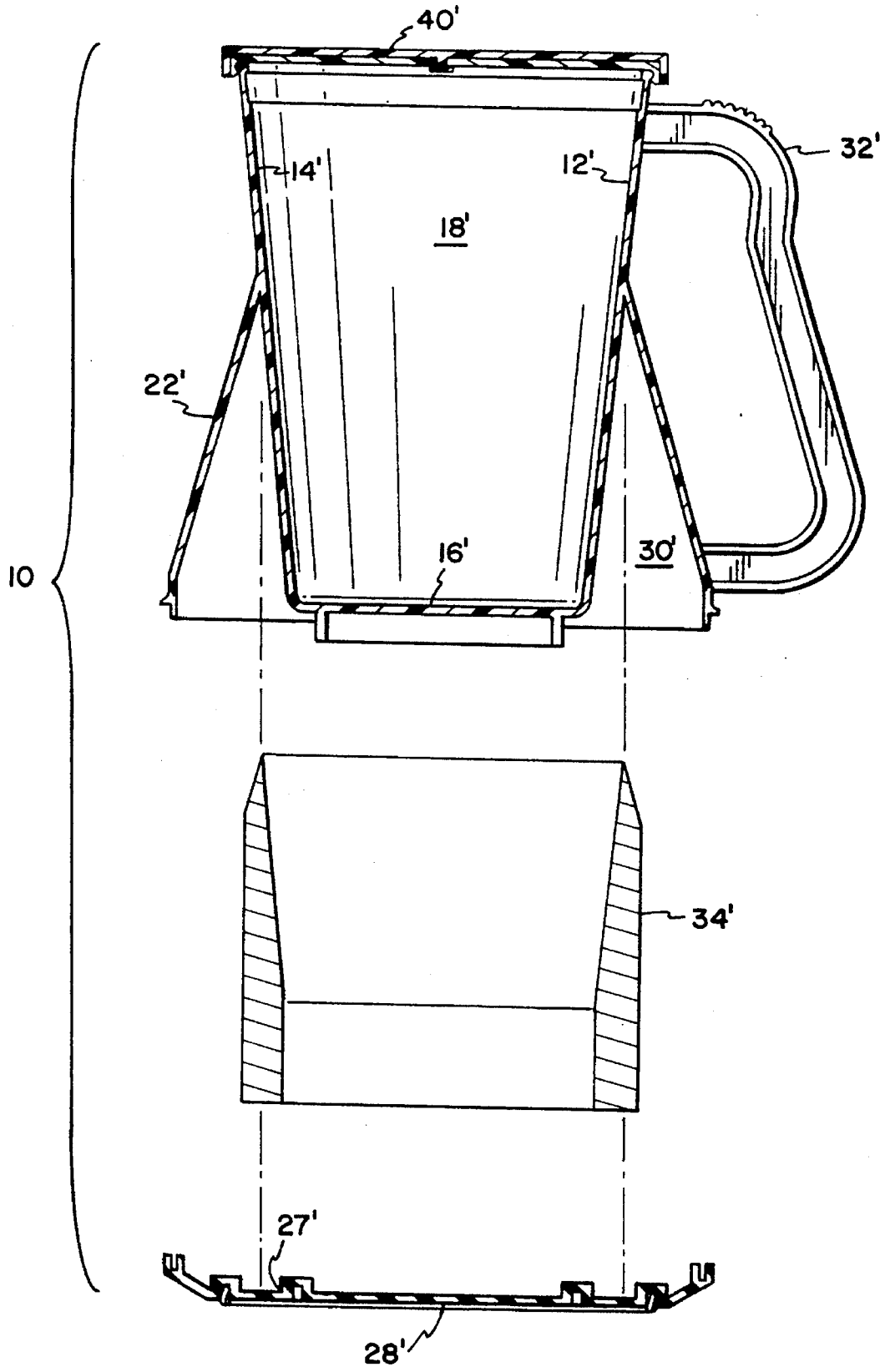
FIG. 3 is a side sectional view of an alternative embodiment of the view of FIG. 1 shown partially exploded.

Referring now to the several drawing figures in which identical elements are numbered identically throughout, a description of the preferred embodiment of the present invention will now be provided.

With best reference to FIG. 1, a coffee cup 10 includes an inner container or vessel 12. Vessel 12 is generally cylindrical in shape and includes a cylindrical wall 14 having an enclosing bottom wall 16. The walls 14,16 define a volume 18 for retaining a beverage such as coffee or the like.

Opposite bottom 16, the vessel 12 is provided with an open end 20 to facilitate pouring of a beverage into volume 18 or drinking the beverage from volume 18. An optional cover 40 may be placed over the opening 20. The cover 40 has a cutout 42 to permit a user to drink the beverage from chamber 18 when cover 40 is in place.

An outer wall 22 surrounds the vessel 12. The outer wall 22 is frusto-conical in shape and extends from an upper end 24 to a base end 26. While the frusto-conical shape is not necessary for practicing the present invention, it is preferred for purposes of providing stability to the cup 10 when placed on a surface such as on a surface in a moving vehicle or the like.

In the preferred embodiment shown, the upper end 22 is secured to the vessel 12 at approximately a mid-point between ends 16,20. While this is a preferred embodiment, the upper end 24 could be attached to the vessel at the end 20 of vessel 12.

The base 26 is generally parallel to the plane of the opening 20. A bottom cover 28 is secured to the base 26. The cover 28, outer wall 22 and vessel 12 cooperate to define an enclosed volume 30 which surrounds the lower half (in the preferred embodiment) of the cylindrical wall 14 and extends beneath the bottom wall 16 of vessel 12. A handle 32 is provided secured to the vessel 12 and outer wall 22 to permit the cup 10 to be grasped by a user.

The bottom cover 28 may be secured to the base 26 in any desired manner such as threading the base 28 onto the bottom 26 or by ultrasonically welding plastic material of both the outer wall 22 and the bottom cover 28. Skid resistant pads 29 project from base 28.

The chamber 30 is substantially filled with a microwave receptive material 34. In a preferred embodiment, the microwave receptive material 34 is a so-called phase change material.

A preferred phase change material is commercially available through Phase Change Laboratories, Inc., San Diego, Calif., and is a free-flowing powder. The phase change material includes a linear crystalline alkyl hydrocarbon dispersed within a finely divided silica. The phase change material stays in powder form above and below the melting point of the hydrocarbon. The hydrocarbon melting point can be selected to be one of a number of different temperatures. For example, the hydrocarbon may be selected to have a melting point of 147° F., 170° F. or other temperature. For coffee cup, 170° F. is preferred. The phase change material results in an effective storing of thermal energy with energy being released at about the melting point of the hydrocarbon. Accordingly, the cup 10 may be placed in a conventional microwave oven and heated by microwave energy to heat the phase change material above the melting point of the hydrocarbon. The phase change material ensures that the melting point temperature of the hydrocarbon is retained for a substantial period of time (for example, one hour or more) after application of the microwave energy. A preferred phase change material is described more fully in U.S. Pat. No. 5,211,949.

It is desirable that the material of the cup 10 (other than the microwave receptive material 34) be substantially transparent to microwave energy. Also, it is desirable to avoid bursting of the outer wall 22 which may result from overheating the microwave material 34. For example, air may be captured in volume 30 and may heat and expand causing bursting of wall 22. To this end, the outer wall 22 is formed of a plastic material which is transparent to microwave energy and which has a melting point greater than the melting point of the hydrocarbon of the phase change material but less than a temperature at which there may be substantial risk to bursting of the outer wall 22. A preferred material for outer wall 22 (as well as vessel 12) is polypropylene with a melting point of 350° F. and a softening point of 325° F.

An alternative design may include the addition of a layer (not shown) of insulative material on the inner surface of wall 22 to retain the heat of material 34.

Figure 4:
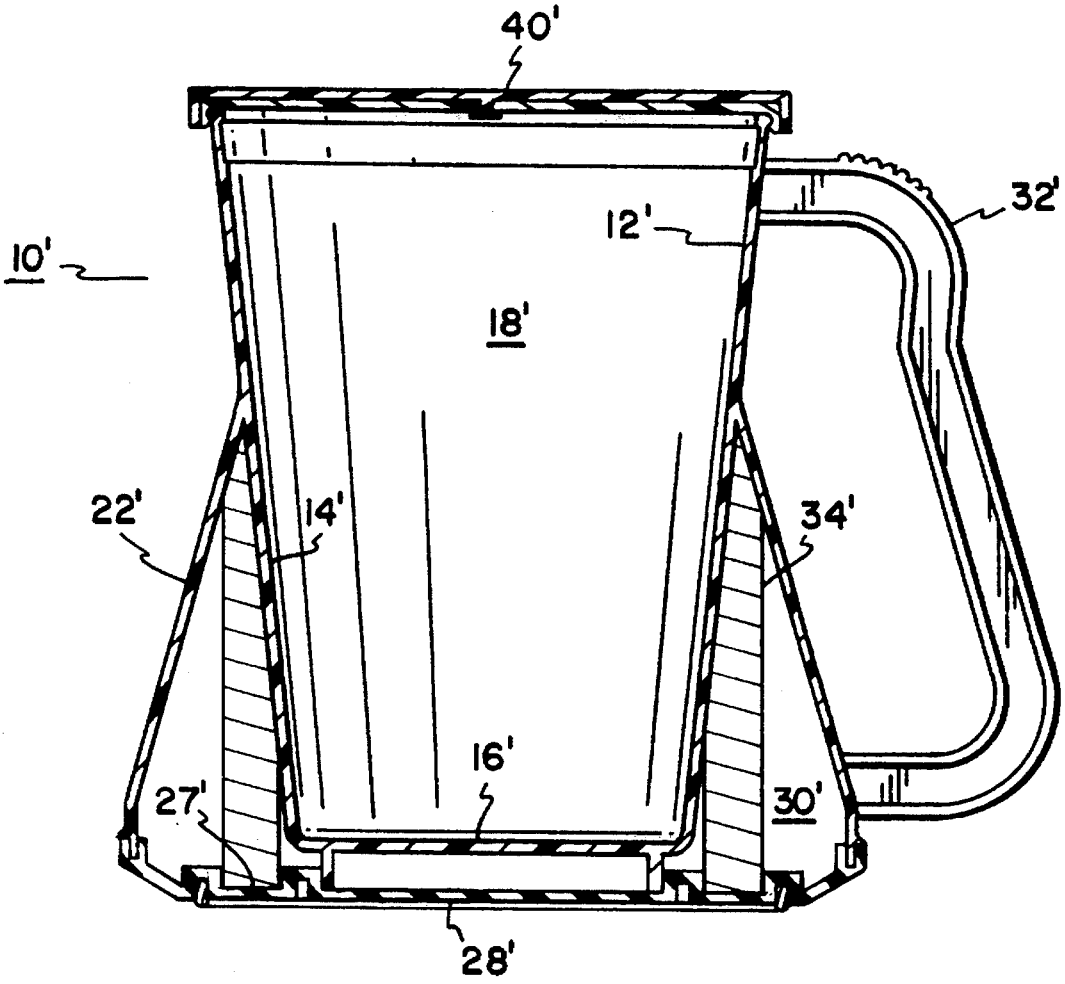
FIG. 4 is the assembled view of FIG. 3.

FIGS. 3 and 4 show an alternative embodiment of the present invention. In FIG. 3, elements identical to those with respect to FIG. 1 are numbered identically throughout.

The cup 10' has vessel 12' and an outer wall 22' which surrounds an inner wall 14' of the vessel 12' walls 22' and 14' define an enclosed volume 30'.

In FIG. 3, the phase change material 34' is in the form of a solid cylinder sized to be received in the volume of 30'. As in the embodiment of FIG. 1, the base 28' is ultrasonically welded to the outer wall 22' in order to completely seal the volume 30. The cylinder 34' is shaped to fit within volume 30' adjacent to and in contact with wall 14' The bottom of cylinder 34' is received within a groove 28' of bottom cover 28'.

The cylinder 34' is a high-density polyethylene which is cold molded, and includes a silica which is impregnated with a wax. The cylinder 34' also includes a carbon black dispersed throughout the cylinder 34'. The high-density polyethylene permits the cylinder 34' to be cold molded into any desired shape. The silica acts as a sponge which can retain the wax in both a melted and a solid state. The carbon black is a receptor for microwave energy. At 140°, the wax melts but stays retained within the silica. The desired energy for eventual release into the beverage container 10' is stored in the latent heat as the wax changes phase from solid to liquid state. The structure of the cylinder 34', including the polyethylene, can melt at a temperature which would soften and melt the container before vaporization of the wax or other constituents of the ring occurs. Such a cylinder 34' is a commercially available item through the aforementioned Phase Change Laboratories.

During heating, the wax of cylinder 34' will melt at about 140° F. The cylinder 34' will overall melt at about 230° and vaporization of the cylinder 34' will occur at about 360° F. The plastic of the container 14' softens at 320° F. and melts at about 350° F. Accordingly, the container material has a melting point which is greater than the melting point of the cylinder 34' and less than the vaporization of the cylinder 34'.

In a preferred embodiment, the interior vessel wall 14' will be made thinner than the exterior wall 22'. As a result, the interior wall 14 will melt before the exterior wall 22'. So, any melted material from the cylinder 34' will flow into the container 18. While, in a preferred embodiment, inner container 14 melts before exterior wall 22', it will be appreciated that either of inner container 14' or exterior wall 22 could melt. By permitting the walls 14', 22' to melt prior to vaporization of the material 34' (or material 34 in FIG. 1), bursting of the walls 22', 14' is avoided.

From the foregoing detailed description of the present invention, it has been shown how the objects of the invention have been obtained in a preferred manner. However, modifications and equivalents of the disclosed concepts such as those that readily occur to one skilled in the art and are intended to be included within the scope of the claims which are appended hereto.

What is claimed is:

1. A container for holding a beverage fluid, said container comprising:

an inner vessel having walls including a bottom wall and a side wall defining in a fluid retaining volume and having an opening for admitting and discharging a fluid into and from said volume;

an outer wall at least partially surrounding said vessel and cooperating with said walls of said vessel to define an enclosed chamber at least practically surrounding said inner vessel;

a microwave receptive material disposed within said chamber; and at least one of said inner vessel and said outer wall is formed of a material which is generally transparent to microwave radiation and having a container melting point temperature greater than a melting point temperature of said microwave receptive material and less than a temperature of vaporization of said microwave receptive material.

2. A container according to claim 1 wherein said microwave receptive material is a phase change material containing a phase change component having a predetermined melting point temperature.

3. A container according to claim 1 wherein said melting point temperature of said material is about 350° F.

4. A container according to claim 1 wherein said outer wall includes a base in spaced relation to said bottom wall with said base having a width greater than said bottom wall and with said outer wall having a side wall extending from said base to a point on said sidewall of said inner vessel spaced from said opening.

5. A container according to claim 2 wherein said microwave receptive material is a powder.

6. A container according to claim 2 wherein said microwave receptive material is a non-flowable solid.

7. A container according to claim 1 wherein said microwave receptive material includes a wax impregnated silica where said wax stores energy in a latent phase by passing from solid wax to liquid wax with both said solid and said liquid wax retained within said silica.

8. A container according to claim 7 wherein said microwave receptive material includes a microwave receptive element dispersed within said material.

9. A container according to claim 8 wherein said microwave receptive material is a carbon black.

10. A container according to claim 7 wherein said silica is supported in a high-density polyethylene structure.

* * * * *